US005631880A

United States Patent [19]

Houlihan

[11] Patent Number: 5,631,880

[45] Date of Patent: May 20, 1997

[54] PROTECTIVE INDICATOR RING FOR A WRISTWATCH

[75] Inventor: John T. Houlihan, Southbury, Conn.

[73] Assignee: Timex Corporation, Middlebury, Conn.

[21] Appl. No.: 618,887

[22] Filed: Mar. 20, 1996

[51] Int. Cl.[6] ..... G04B 47/06

[52] U.S. Cl. ..... 368/287; 368/286

[58] Field of Search ..... 368/281, 282, 368/286, 287

[56] References Cited

U.S. PATENT DOCUMENTS

| | | | |
|---|---|---|---|
| D. 310,637 | 9/1990 | Sugano | D10/30 |
| 837,206 | 11/1906 | Ely | 368/287 |
| 2,617,249 | 11/1952 | Devay | 58/88 |
| 3,553,958 | 1/1971 | Grohoski | 58/91 |
| 4,357,791 | 11/1982 | Hope, Sr. et al. | 57/122 |
| 4,511,261 | 4/1985 | Mishima | 368/286 |
| 4,835,750 | 5/1989 | Quincey | 368/286 |
| 4,837,756 | 6/1989 | Hartmann et al. | 368/286 |

FOREIGN PATENT DOCUMENTS

| | | | |
|---|---|---|---|
| 2004053 | 8/1970 | Germany | 368/287 |
| 414471 | 2/1966 | Switzerland | 368/287 |

*Primary Examiner*—Bernard Roskoski
*Attorney, Agent, or Firm*—William C. Crutcher

[57] ABSTRACT

A rotatable indicator ring for a wristwatch is an assembly of a first ring of hard resin material rotatably mounted and retained ont he watch bezel, and a soft elastomeric second ring extending beyond and locked to the first ring. The first ring has decorative or functional indicia and the second ring has a frictional surface facilitating turning the assembly and protecting the watch from impact and shock.

8 Claims, 2 Drawing Sheets

PROTECTIVE INDICATOR RING FOR A WRISTWATCH

This invention relates generally to wristwatches with rotatable indicator rings mounted on the watch bezel, and more particularly to wristwatches of this type which are intended for a rugged environment.

Watch designers have added to the functionality of wristwatches, both of the digital or analog type, by providing rotatable indicator rings. The indicator rings may be decorative in nature and also contain useful indicia, such as a compass rose, an elapsed time indicator, a tide indicator and so forth. A construction for a watch indicator ring is shown in U.S. Pat. No. 3,553,958 issued Jan. 12, 1991 to R. J. Grohoski and assigned to the present assignee. That patent describes a rotatable indicator ring of relatively rigid plastic resin such as nylon rotatably mounted on the watch bezel. The retaining means comprises a reverse tapered wall cooperating with a similar wall on the ring and holding it for rotation above an annular ledge portion on the bezel. Sometimes the ring is difficult to turn and knurled surfaces or raised projections are provided on the ring to assist in gripping and turning the ring.

In addition to increasing functionality of the wristwatch by means of an indicator ring, the watch designer desires to protect the watch against impact or shock caused by the watch striking an object inadvertently while being worn. A number of patents disclose protective enclosures, examples being seen in U.S. Pat. No. 4,511,261 issued Apr. 16, 1985 to Mishima, U.S. Pat. No. 4,837,756 issued Jun. 6, 1989 to Hartman et al. or U.S. Pat. No. 4,835,750 issued May 30, 1989 to Quincey, which are provided as separate accessories to protect a watch. Other prior art references have disclosed rubber or elastomeric rings attached to and surrounding the watch bezel or portions thereof. Examples of these are seen in U.S. Pat. No. 837,206 issued Nov. 27, 1906 to Ely, U.S. Pat. No. 2,617,249 issued Nov. 11, 1952 to Devay, and design patent 310,637 issued Sep. 18, 1990 to Sugano. While the foregoing patents serve to provide a measure of protection to the watch cases and the contents, they are not rotatable nor suitable for indicator rings.

Accordingly, one object of the present invention is to provide an improved protective indicator ring for a wristwatch.

Another object of the invention is to provide an improved indicator ring with means to protect the ring and the wristwatch against impact or shock.

Still another object of the invention is to provide an improved gripping means for rotating a wristwatch indicator ring.

SUMMARY OF THE INVENTION

Briefly stated, the invention comprises an improved protective indicator ring assembly for a wristwatch of the type having a watch case with a bezel, the bezel having an annular ledge portion and a circular wall portion extending upward from the annular ledge portion, and having retaining means for mounting and securing an indicator ring for rotation above the annular ledge portion and outside of the circular wall portion, the indicator ring assembly comprising a first ring of rigid material adapted to be rotatably mounted and held on the watch bezel by the retaining means, and a second ring of impact absorbing material having a greater outer diameter than the first ring and disposed thereon, the first and second rings being provided with interlocking portions, whereby the first ring may be rotated by and protected by the second ring. Preferably the first ring is of rigid plastic material, the second ring is of elastomeric plastic material, and the interlocking portions comprise circumferentially spaced lugs with mating circumferentially spaced recesses formed in the first and second rings respectively. Alternatively, the first and second rings may be interlocked by an overmolding process.

DRAWING

Further details of the invention will be apparent by reference to the following description, taken in connection with the accompanying drawings, in which:

FIG. 1 is a top plan view of wristwatch case and bezel, omitting the watch band, FIG. 2 is a left side elevation drawing of the wristwatch case of FIG. 1, FIG. 3 is a enlarged partial side elevation view in section, omitting the watch movement and taken along lines III—III of FIG. 1, FIG. 4 is a top plan view of the improved indicator ring assembly, FIG. 5 is a bottom plan view of the improved indicator ring assembly, FIG. 6 is an elevation view, in cross section, taken along lines VI—VI of FIG. 5, and FIG. 7 is a similar cross section taken along lines VII—VII of FIG. 5.

DESCRIPTION OF THE PREFERRED EMBODIMENT

Figure 2:
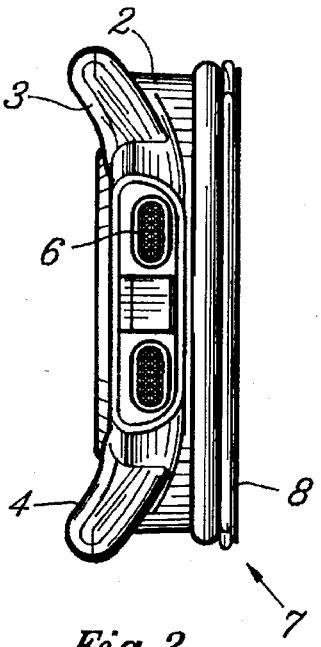
Figure 1:
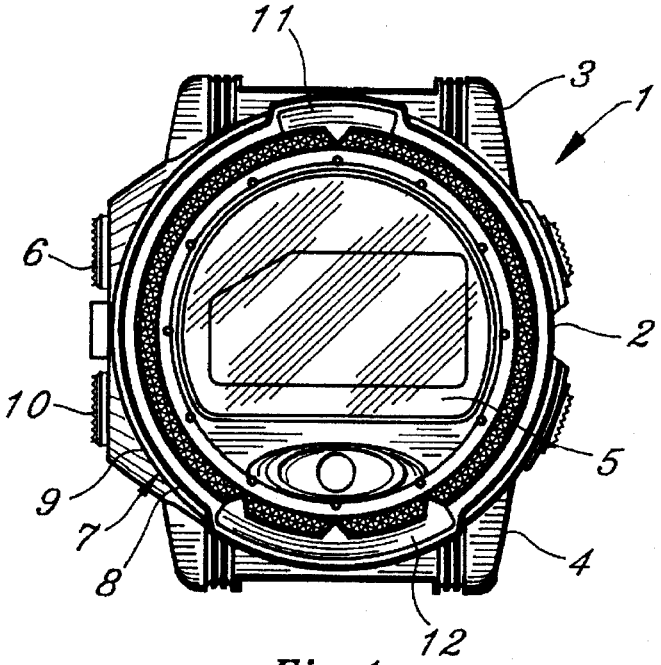

Referring now to FIG. 1 of the drawing, a watch casing shown generally as 1 comprises a watch bezel 2 integrally formed with lugs 3, 4 for attachment to the watchband in a manner well known in the art. The wristwatch 1 happens to be a digital watch with a display 5 and several operative pushbuttons 6. The particular shape or function of wristwatch 1 is immaterial to the present invention, it merely being illustrative of a general type of rugged wristwatch suitable for outdoor use, or for athletes or sportspersons. As such, it is susceptible to impact or shock due to accidental striking of the watch against objects. The illustrated watch could also be an analog wristwatch with hands, the particular type of movement also being immaterial to the present invention.

In accordance with the present invention, an improved protective indicator ring assembly is shown generally at 7. Indicator ring assembly 7 is an assembly of two rings, comprising a first ring 8 of rigid material and a second ring 9 of impact absorbing material. Ring 8 may be provided with a decorative design such as 10, molded into the plastic, and may also be provided with separate or integrated indicator elements as shown at 11 and 12.

Figure 3:
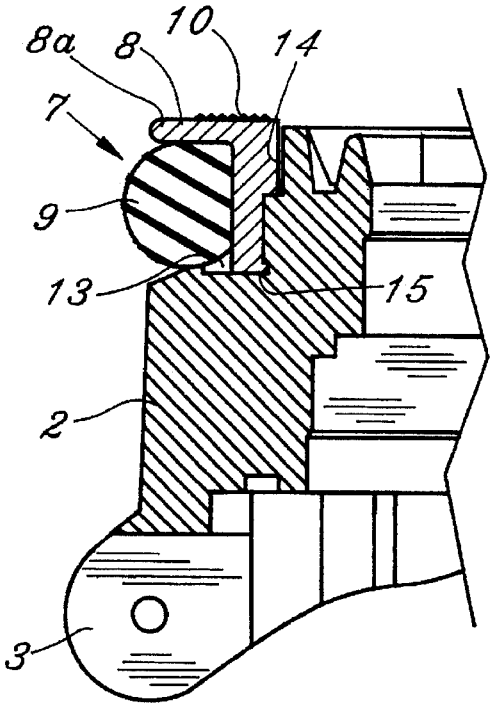

FIG. 3 of the drawing shows a cross section through one end of the watch bezel portion of the watch case with the internal components removed for ease of understanding. The watch bezel 2 is shown to include an annular ledge 13 having a circular wall portion 11 extending upward from ledge 13. Circular wall 14 may be stepped with two or more diameters to allow a wider top face for the first ring 8, as should be apparent from the drawing.

The indicator ring assembly 7 is rotatably mounted and retained on the watch bezel 2 by suitable retaining means. An undercut groove 15 provides the means to retain ring assembly 7 on the bezel as will be explained. Alternatively, the retaining means may comprise a reverse tapered wall as fully described in the aforementioned Grohoski U.S. Pat. No. 3,553,958, which is incorporated herein by reference.

Figure 4:
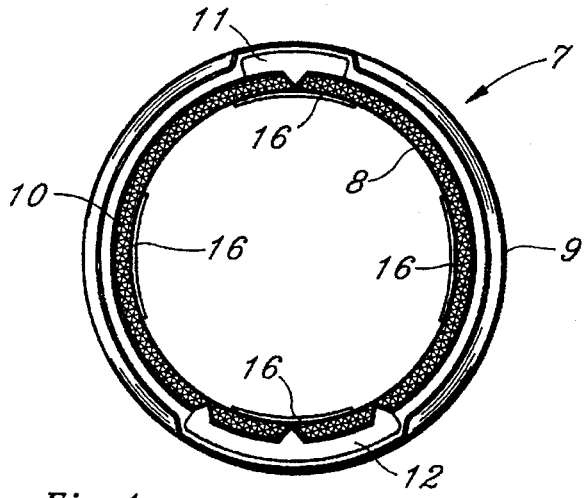

Referring now to FIG. 4 of the drawing, the improved protective indicator ring assembly 7 is shown removed from the watch. Ring 8 is composed of rigid plastic material having a non-functional or decorative knurling design 10. The indicator elements 11, 12 may be small metal plates attached to ring 8 by adhesive. Four circumferentially spaced retaining flanges 16 are suitably positioned to be snap-fit and received in the undercut recess 15, as shown in FIG. 3. The flanges 16 retain the ring 8, while allowing it to rotate.

Figure 5:
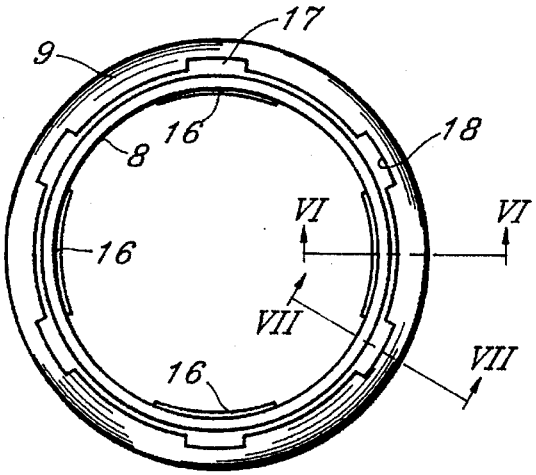

Reference to the bottom view of FIG. 5, illustrates that the rigid first ring 8 includes circumferentially spaced lugs 17. Similarly, the second ring 9 includes mating, circumferentially spaced recesses 18. Lugs 17 and recesses 18 provide interlocking portions, whereby the first ring may be rotated by manually turning the second ring 9. The lugs 17 fit snugly in the recesses 18 and ring 9 is prevented from disengagement by the overhanging lip 8*a*. Alternatively, the second ring may be overmolded over the lugs 17 of the first ring.

The second ring 9 is preferably of a soft elastomeric material. This enables it to absorb impact or shock, and also to provide a frictional surface to enable ease of gripping and manually rotating the indicator ring assembly, while at the same time protecting the indicator ring assembly and watch against damage.

Figure 6:
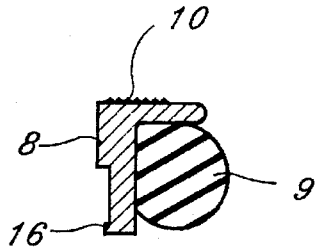
Figure 7:
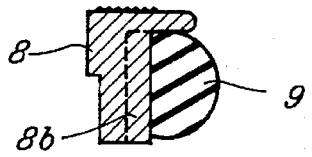

Reference to the cross section through FIG. 6 illustrates that ring 9 has a greater diameter than ring 8, thereby protecting it against objects striking the watch indicator ring from a radial direction. Also the location of the retaining flanges 16 is illustrated in FIG. 6. FIG. 7 is a cross section through the indicator ring assembly at a different location, illustrating the interlocked ring inner diameter at 8*b* in dashed lines.

While there has been described what is considered to be the preferred embodiment of the invention, other modifications will become apparent to those skilled in the art, and it is desired to cover in the appended claims all such modifications as fall within the true spirit and scope of the invention.

I claim:

1. An improved protective indicator ring assembly for a wristwatch of the type having a watch case with a bezel, the bezel having an annular ledge portion and a circular wall portion extending upward from the annular ledge portion, and having retaining means for rotatably mounting an indicator ring for rotation above said annular ledge portion and outside of said circular wall portion, the indicator ring comprising:

a first ring of rigid material adapted to be rotatably mounted and held on the watch bezel by said retaining means, and a second ring of impact absorbing material having a greater outer diameter than said first ring and disposed thereon, said first and second ring being provided with interlocking portions, whereby the first ring may be rotated by the second ring, and the watch protected by the second ring.

2. The indicator ring assembly of claim 1, wherein said first ring defines a plurality of radial lugs and said second ring defines a plurality of recesses located to receive said lugs, said lugs and recesses comprising said interlocking portions.

3. The combination according to claim 2, wherein said first ring defines a lip overhanging a portion of the second ring to prevent disengagement from the indicator ring assembly.

4. The combination according to claim 1, wherein the first ring defines a decorative design formed in the rigid material.

5. The combination according to claim 1, wherein the impact absorbing material is an elastomeric resin, having a good frictional gripping surface.

6. The combination according to claim 1, wherein the interlocking portions are formed by the second ring material being molded over portions of the first ring material.

7. The combination according to claim 1, wherein the first ring defines flanges for cooperating with said retaining means on the circular wall portion.

8. The combination according to claim 1, wherein the first ring defines a wall with a reverse taper for cooperating with said retaining means on the circular wall portion.

* * * * *